United States Patent [19]

Greenberg et al.

[11] 4,173,190

[45] Nov. 6, 1979

[54] SLUDGE INCINERATOR UTILIZING COILED CHANNEL IMMERSED IN MOLTEN SALT AND METHOD OF OXIDIZING SLUDGE UTILIZING SAME

[75] Inventors: Jacob Greenberg, Margate; John E. Robertson, Cardiff, both of N.J.

[73] Assignee: Anti-Pollution Systems, Inc., Pleasantville, N.J.

[21] Appl. No.: 923,720

[22] Filed: Jul. 12, 1978

[51] Int. Cl.[2] ..... F23G 5/12

[52] U.S. Cl. ..... 110/243; 110/215; 110/346

[58] Field of Search ..... 110/238, 235, 245, 243, 110/341, 346, 215

[56] References Cited

U.S. PATENT DOCUMENTS

| | | | |
|---|---|---|---|
| 3,295,478 | 1/1967 | Lowe | 110/238 |
| 3,642,583 | 2/1972 | Greenberg et al. | 110/243 X |
| 3,647,358 | 3/1972 | Greenberg | 110/215 |
| 3,747,542 | 7/1973 | Ruuhola et al. | 110/243 X |
| 3,890,908 | 6/1975 | Klenck et al. | 110/243 |
| 3,926,129 | 12/1975 | Wall | 110/243 X |
| 3,974,784 | 8/1976 | Greenberg | 110/215 |

FOREIGN PATENT DOCUMENTS

| | | | |
|---|---|---|---|
| 821607 | 12/1937 | France | 110/234 |

*Primary Examiner*—Edward G. Favors

*Attorney, Agent, or Firm*—Woodcock, Washburn, Kurtz & Mackiewicz

[57] ABSTRACT

An incinerator is provided having an extended length of tubing, preferably coiled, and immersed within a bath of molten salt. Means are provided for introducing sludge at a controlled rate along with hot air under pressure for carrying the sludge through the immersed length of tubing, the air and the heat supplied from the molten salt bath causing concurrent drying and burning of the sludge. The exhausted gases are further oxidized by passing them through a portion of the molten salt bath, while solids are separated out and removed.

12 Claims, 1 Drawing Figure

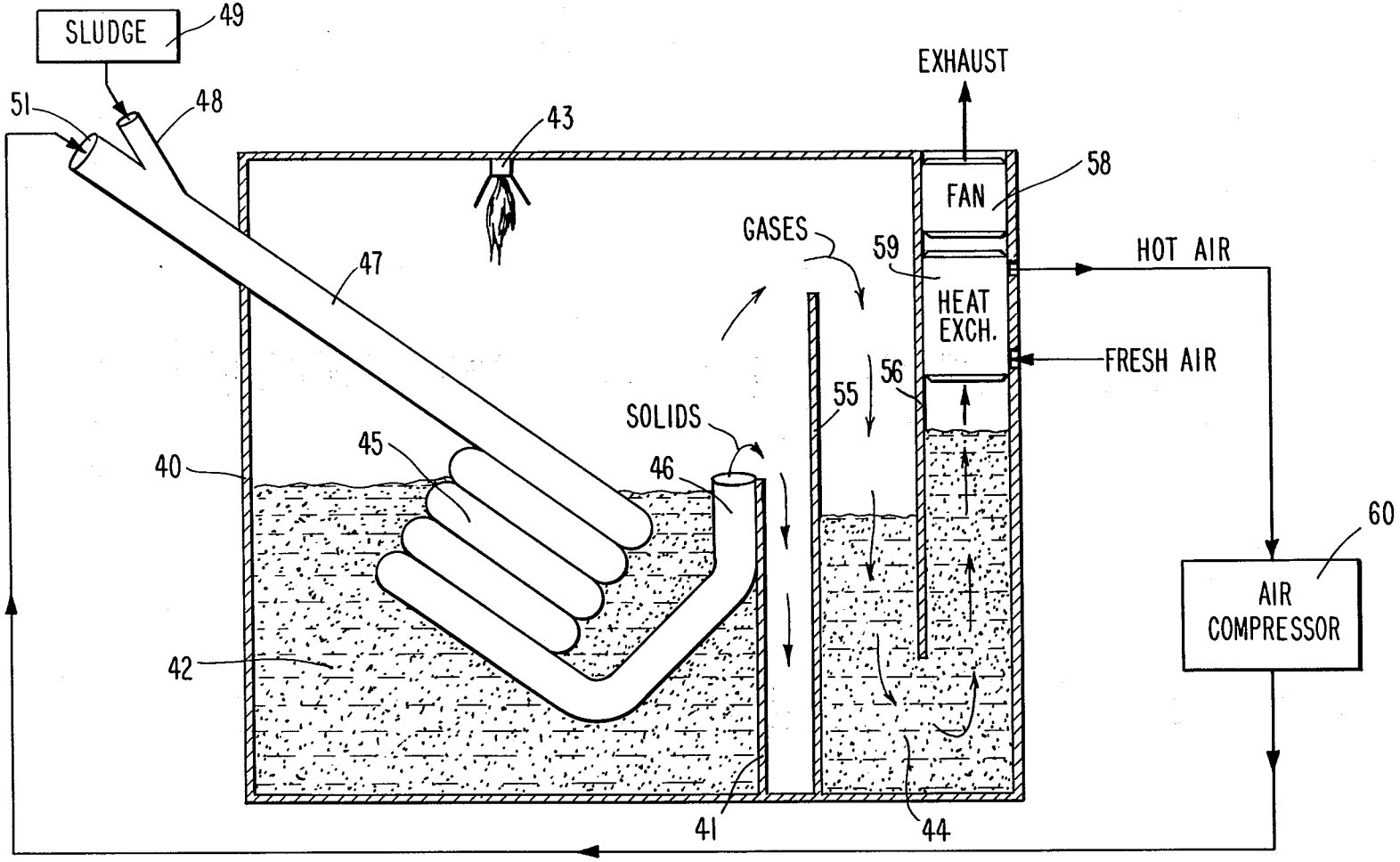
60
AIR COMPRESSOR
HOT AIR
FRESH AIR
58
EXHAUST
FAN
HEAT EXCH.
59
56
55
44
GASES
SOLIDS
46
41
43
47
45
49
48
SLUDGE
51
40
42

SLUDGE INCINERATOR UTILIZING COILED CHANNEL IMMERSED IN MOLTEN SALT AND METHOD OF OXIDIZING SLUDGE UTILIZING SAME

BACKGROUND OF THE INVENTION

The present invention relates to the field of sludge disposal incinerators, and particularly to incinerators utilizing molten salts.

The handling of water-containing solids has long been a difficult problem, both from an engineering point of view and more particularly from an economics point of view. The burning or incineration of water-containing solids, hereinafter generically referred to as sludge, is an extremely fuel intensive operation. This is particularly the case for municipal and industrial sludges, which provide a large portion of the sludges which must be removed. The reasons that such burning or incineration is so fuel intensive include (1) the high heat of vaporization of water, (2) the low heat transfer through the water containing materials and (3) the difficulty, by conventional means, of creating small, low density, high surface area particles which are amenable to efficient heat treatment.

The outstanding need for more fuel-efficient means of treating sludge, as well as sludge treatment methods which avoid pollution of air or water, has lead to a proliferation of various techniques of treating sludge. Most industrial or municipal sludges are initially precipitated at a solids content of approximately 4% solid, 96% water. The resulting material may be dried mechanically by centrifuge, filter-press or vacuum belt filter to a resulting sludge of approximately 30% solid, 70% water. Even after this processing, the oxidation of the sludge is highly fuel intensive for the reasons noted above.

One technique for conditioning sludge for subsequent incineration is that of utilizing a jet mill or flash dryer. By the use of hot compressed air, the sludge can be dried to a dust-like consistency of approximately 80% solids, 20% water. This material is then in much better condition to be further oxidized or pyrolyzed. However, operation of a jet mill type device requires proper conditions for suspension of the water bearing solids within it, i.e., the sludge must be fluidized for travel through the mill. Consequently, the sludge must be introduced into the mill in as small pieces as possible, since large wet solids cannot be suspended in an airstream. Further, such mills require high pressure, and if the pressure falls below a threshold of about 2 inches of mercury, the sludge is not suspended in the compressed air. In such an event, reduction of the sludge to fine particles cannot occur. Further, the temperature of the air within the mill must be held at a high level so as to provide efficient heat exchange to remove water from the sludge. This means that the compressed air introduced into the mill must be heated to a very high temperature prior to introduction into the mill.

There remains a substantial need for an efficient means and method of treating relatively wet sludge which has not been elaborately preconditioned, and providing such treatment with maximum fuel efficiency.

SUMMARY OF THE INVENTION

It is an object of this invention to provide a means and method of treating sludge which incorporates simultaneous drying and oxidizing of solids and particulates in the sludge.

It is a more specific object of this invention to provide an incinerator wherein the sludge is introduced along with a compressed hot air feed, the incinerator providing for a combined temperature and residence time of the sludge which is suitable for efficient oxidation of a large portion of the solid matter in the sludge.

It is another object of this invention to provide an incinerator for treatment of relatively high water content sludge wherein there is provided efficient heat transfer to the sludge, the operating temperatures are reliably controlled at levels suitable for oxidation of the sludge solids, and the metals utilized in the construction of the incinerator are substantially protected from oxidation.

It is another object of this invention to provide a means for carrying out oxidation of high water content sludges in a compact configuration and with a maximum of fuel efficiency. Further, the apparatus used provides for efficient oxidation of organic volatiles so that the gaseous effluent is substantially odor free and suitable for discharging into the air.

In accordance with the above objectives, there is provided an incinerator containing a molten salt bath which is maintained at a predetermined temperature, within which is immersed a length or channel of metal piping in an arrangement, such as a coil, to provide for a suitably long transport channel within the molten salt bath. The input of the transport channel is adapted to receive both sludge and heated air under pressure, the air providing the transport means for passing the sludge through the channel. The channel exit is above the level of the molten salt, and is formed to release the gaseous effluent so that it is drawn through another portion of the molten salt bath where it is further oxidized and scrubbed. The solid effluent is collected and removed. The gaseous effluent is drawn through a heat exchanger, the output of which feeds an air compressor or fan which in turn provides the hot air input to the oxidation channel.

BRIEF DESCRIPTION OF THE DRAWING

The drawing shows, in schematic form, a representation of the incinerator of this invention, and a flow diagram indicating the movement of sludge and air therethrough.

DESCRIPTION OF THE PREFERRED EMBODIMENT

Referring to the drawing, there is shown an incinerator housing 40, made of a metal suitable to withstand the temperatures involved. An enclosure wall 41 defines, together with the housing 40, a volume within which there is maintained a bath of molten salt 42. The volume of the molten salt, or the geometry of the molten salt bath, is not critical, it being essential only that the molten salt have a geometry suitable for efficient maintenance of a desired temperature and also suitable for carrying within it the immersed coil as shown in 45. The molten salt bath is maintained in a heated form by a suitable heat source such as illustrated at 43. Additionally, as is explained below, the oxidation which occurs within the coil or pipe 45 contributes additional heat to the maintenance of the temperature of the salt bath. The molten salt which is employed in the present invention may be selected from the salts disclosed in Greenberg U.S. Pat. No. 3,647,358, entitled "METHOD OF CATALYTICALLY INDUCING OXIDATION OF CARBONACEOUS MATERIALS BY THE USE OF MOLTEN SALTS", which issued on Mar. 7, 1972 and is specifically incorporated herein.

The properties of the molten salts utilized in the present invention are particularly useful in an incinerator by reason of the thermal inertia of "fly-wheel effect" which the salts provide. That is, when the molten salt bath has been brought to a desired temperature, suitably around 1100° F., a substantially constant temperature is provided to the interior of the coil 45, to provide the desired environment for evaporation of water and ignition of solid materials. Most of the organics present in sludge ignite at about 800° F., so maintaining the molten salt bath above such temperature provides the desired environment. Further, the heat produced by the oxidation of the materials will contribute to the total heat within the salt bath, reducing the requirement of fuel that needs to be used in heater 43. The salt, or salt combination which is used must, of course, have a melting point below the desired ignition temperature.

Pipe 45, as shown in the preferred form of a coil, is constructed of conventional materials which are of high heat transfer property and able to effectively withstand the operating temperatures involved. The exact configuration of pipe 45 is a matter of design choice, but it is preferred to coil the pipe to provide for an extended length channel within the relatively small volume defined by the molten salt bath 42. The coil may be spaced more closely to the side walls of the chamber defining the molten bath, and indeed the pipe need not have a conventional coil configuration. The coil need not be tilted as illustrated. The important thing is that the pipe be looped around within the molten bath to define a channel of predetermined length to provide the desired residence time for the sludge which is moved therethrough. The looping provides the means to obtain a significant length within a chamber having dimensions which are small compared to such length. In operation, it has been found that for a molten salt bath of about 8'×3'×5', a coil with a length of about 25 feet provides good operating conditions, in combination with the other operating parameters disclosed herein.

The inlet portion of the pipe 47 extends to the outside of the incinerator housing 40, and contains two feed ports 48 and 51 respectively. Inlet portion 47 provides for tangential feed to the immersed length 45. Feed port 48 is connected to a conventional sludge feeding mechanism 49, which is adapted to introduce the sludge at a predetermined rate. Heated air, maintained at a predetermined pressure, is introduced through feed port 51, such that the air and the sludge meet at a small angle, the air carrying the sludge through length 47 into the submerged channel 45. The output end of channel 45, shown at 46, is elevated above the molten salt bath, and is suitably positioned so that the gaseous portion of the effluent rises above baffle wall 55 and is drawn down into a second portion of the molten salt bath 44. Second portion 44 is shown diagrammatically as being enclosed by baffle wall 55 and the housing 40. In practice, bath portion 44, which acts as a scrubber and further oxidizer, is suitably in heat communication with bath 42. Alternately, it can be provided with a separate heat source. The solids of the effluent from pipe end 46 are directed to a collecting chamber defined by the space within baffle 41 and baffle 46. A reflecting wall or other suitable device may be utilized to direct those solids into the collecting chamber, from which they are removed by conventional means not illustrated.

The gases are drawn down into the molten fluid as indicated at 44, under the influence of fan 58. Baffle 56 ensures that the gases actually are drawn down underneath the fluid level, in the manner disclosed in prior U.S. Pat. Nos. 3,647,358, 3,642,583 and 3,974,784. The molten salt acts as a scrubber and also catalytically induces oxidation of any carbonaceous materials that may remain in the gas stream. When the gas is drawn out of the salt bath 44, it is passed through heat exchanger 59, which draws heat from the gas for the purpose of heating the air which is returned into energy port 51. The air is passed through an air compressor or fan 60, to provide the required pressure.

In operating the incinerator as a system, it has been found that a pressure differential of only about one half inch of mercury is required across the channel 45, in order to move the sludge through the channel. This is a surprising result, inasmuch as conventional jet mill devices require a pressure of about 2-½ inches of mercury. The lower pressure enables the incinerator to use simply a big fan to provide the air compressing function, which results in a savings in both capital expenditure and operating cost. The lower pressure is possible because the heat transfer from bath 42 through the walls of the channel 45 enables carrying out efficient oxidation of the sludge solids, and it is not necessary to maintain the sludge in a suspended, fluidized form. Large wet solids introduced through channel portion 47 do not need to be suspended in the air stream passing through the channel, but only need to be transported down into the portion of the channel 45 where the temperature is sufficiently high that the solids are ignited and burned. Due to the length of channel 45, the sludge is heated for a sufficient residence time that it is not necessary to fluidize the material. It has been determined that by heating the air which is introduced at 51 to a temperature of about 300° F., and maintaining the salt bath temperature at 1100° F., sludge of about 30% solids and 70% water, and having solid particles with sizes up to ½ inch can be transported through the channel and processed efficiently.

The key to the method of this invention is that the high air temperature within the channel 45 (about 1100° F.), plus the fact that the sludge is being moved along, causes relatively efficient drying. At the same time the temperature is high enough to cause efficient igniting of the solids and actual oxidation of same. Further, due to the fact that the channel 45 is substantially immersed in the salt bath, the pipe is protected from an oxidizing atmosphere and is more readily able to transfer heat uniformly to the materials flowing therethrough. Further, because of the high heat capacity of the salt, excessive and non-uniform temperatures are avoided. The salt temperature can readily be controlled both by regulating the feed rate of the compressed air which serves as combustion air and cooling, and by regulating the time that heat is supplied by burner 43. By conventional control means not shown, heater 43 may be controlled to operate only when needed due to a drop in the temperature of the salt bath 42.

In addition, the inside chamber may be fitted with heat transfer pipes passing through the salt bath to remove excess heat generated during continuous operation. Likewise, in order to increase the overall system efficiency, the exhaust from fan 58 may be passed over or blown through the sludge 49 for preliminary drying of the sludge.

The apparatus illustrated in FIG. 1 is to be understood as being illustrative. The channel 45, as previously discussed, may be in a number of forms, so long as it is designed to allow a total travel distance sufficient to provide the desired transit time for the efficient vaporization and oxidation of the sludge. For a 25 ft. length coil, and with a pressure differential of about ½ inch mercury, the average residence time of the materials within the channel 45 is estimated to be in the range of about 5 seconds, although this figure can vary. Residence time can, of course, be modified by changing the pressure differential and the length of the channel. Other forms of channel arrangements can be utilized, toroidal or non-toroidal, as long as the required residence time is achieved and also as long as the channel dimensions are suitable and the metal from which the channel is made has a good heat transfer characteristic. For example, it would not be efficient to employ a relatively small tightly wound torus type channel, with relatively little heat transfer area in contact with the molten salt compared to the channel length.

It is to be noted that the temperature of the bath is maintained at a level such that the interior of the channel is hot enough to ignite most of the solids in the sludge. Obviously, some random components could be contained which would not ignite at 1100° F. or even higher, but when speaking of the ignition temperature of the sludge solids, such random and relatively non-ignitable random components are not included. Also, while it has been found efficient to pre-heat the input air to 300° F., good operation can be obtained with lesser pre-heating.

We claim:

1. An incinerator for treatment of sludge and high water content matter, comprising:

a. a molten salt bath contained in a housing;

b. an enclosed channel made of a high heat transfer material, said channel being immersed in said bath whereby the interior of said channel is maintained at about the temperature of said bath;

c. temperature means for maintaining said bath at a temperature above the ignition temperature of solids contained in said sludge;

d. input means for inputting sludge and air into said channel;

e. output means for outputting effluent from said channel; and f. pressure means communicating with said input means and said output means for providing a pressure between said input means and said output means, to move said air and sludge into said channel, wherein said sludge is dried and oxidized, and to move the products of the drying and oxidizing to said output means as effluent.

2. The incinerator as described in claim 1, wherein said channel is a metal pipe in a looped arrangement.

3. The incinerator as described in claim 1, wherein said channel length is greater than any of the dimensions of said housing.

4. The incinerator as described in claim 1, wherein said pressure means comprises a fan system for maintaining the pressure differential across said channel at about one half inch of mercury.

5. The incinerator as described in claim 1, comprising heating means for heating the air introduced through said input means to at least about 300° F.

6. The incinerator as described in claim 1, comprising means for separating the solids and gases in said effluent.

7. The incinerator as described in claim 1, comprising second treating means for further oxidizing and scrubbing gases contained in said effluent.

8. The incinerator as described in claim 7, wherein said second treating means comprises a second molten salt bath, and means for drawing said gases through said bath, whereby carbonaceous materials in said gases are oxidized.

9. The incinerator as described in claim 1, comprising exhaust means for exhausting the gaseous portion of said effluent, and heat exchange means positioned between said exhaust means and said output means whereby said gaseous portion is drawn through said heat exchange means, and connecting means connecting the output of said heat exchange means to said input means to provide an input of hot air into said channel.

10. A method for efficiently drying and burning sludge, said sludge having a high water content and comprising solids, said method utilizing a channel of high heat transfer material immersed within a molten salt bath, said channel being adapted for transporting gases and particulates therethrough under pressure, comprising:

a. maintaining said molten bath at a temperature in excess of the ignition temperature of said solids;

b. introducing sludge into said channel;

c. introducing air into said channel along with the sludge, and maintaining a predetermined pressure differential across said channel sufficient to exhaust introduced sludge in vaporized and particulate form from said channel after a predetermined residence time, whereby during said residence time said sludge is vaporized and burned due to the movement of said sludge therethrough and due to the heat transfer to the interior of said channel from said molten salt bath.

11. The method as described in claim 10, comprising heating said introduced air to a temperature of at least about 300° prior to said introducing.

12. The method as described in claim 10, comprising drawing the gaseous output from said channel through a second molten salt bath, whereby said gaseous component is scrubbed and carbonaceous materials carried by same are further oxidized.

* * * * *